US005980300A

United States Patent [19]

Okabe

[11] Patent Number: 5,980,300

[45] Date of Patent: Nov. 9, 1999

[54] PRESSURE WELDING TERMINAL

[75] Inventor: Toshiaki Okabe, Shizuoka, Japan

[73] Assignee: Yazaki Corporation, Tokyo, Japan

[21] Appl. No.: 08/864,920

[22] Filed: May 29, 1997

[30] Foreign Application Priority Data

Jun. 20, 1996 [JP] Japan ..... 8-160173

[51] Int. Cl.[6] ..... H01R 4/24

[52] U.S. Cl. ..... 439/397

[58] Field of Search ..... 439/397, 395, 439/399, 400, 401

[56] References Cited

U.S. PATENT DOCUMENTS 3,162,501 12/1964 Wahl ..... 439/399
4,385,794 5/1983 Lucius .
5,380,218 1/1995 Yamamoto et al. ..... 439/397

*Primary Examiner*—Steven L. Stephan
*Assistant Examiner*—Eugene G. Byrd
*Attorney, Agent, or Firm*—Armstrong, Westerman, Hattori, McLeland & Naughton

[57] ABSTRACT

In a pressure welding terminal comprising at least one pair of pressure welding segments formed at side walls of a terminal, the pressure welding segments are formed by punching and raising a part of each side wall. The die wear caused by punching is positioned at the tension side thereof where a tension of a connected electric wire is applied when it is pulled. Each of the pressure welding segments is formed by raising an inner portion of a U-shaped cutout slit punched at each of said side walls in a direction opposite to a direction of punching and the pressure welding segments are arranged to face with each other to form a slot therebetween into which an electric wire is press fitted to provide the pressure welding.

5 Claims, 4 Drawing Sheets

FIG. 1B
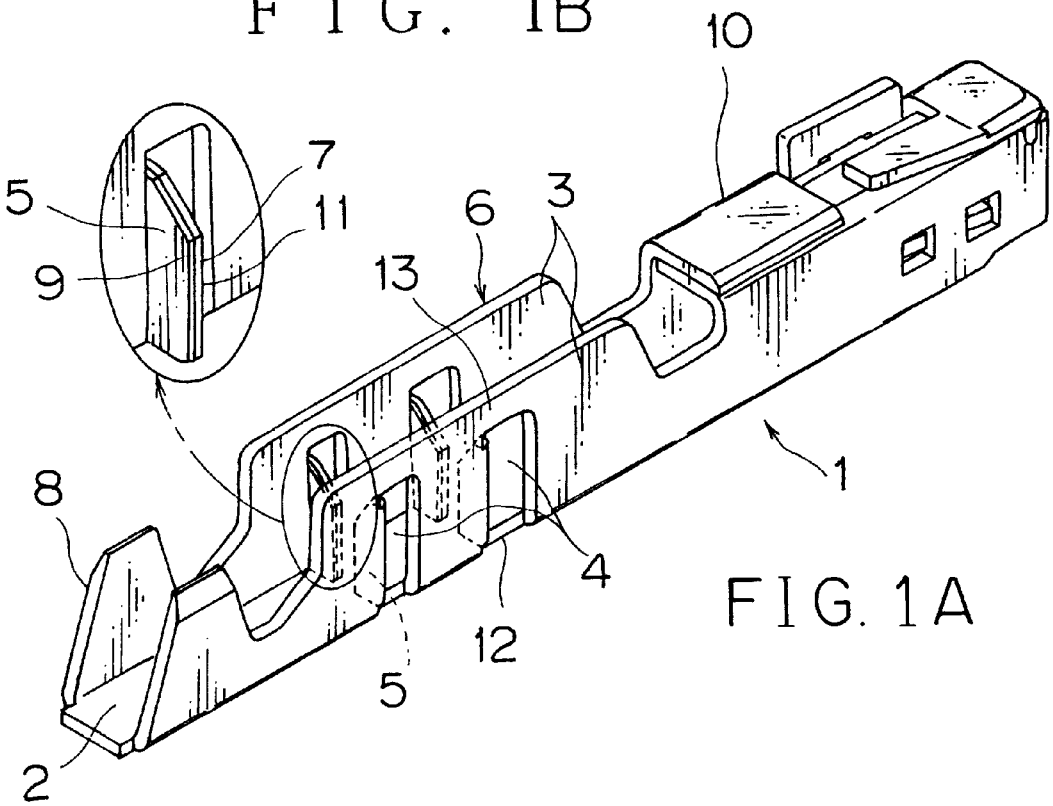
FIG. 1A
FIG. 2A
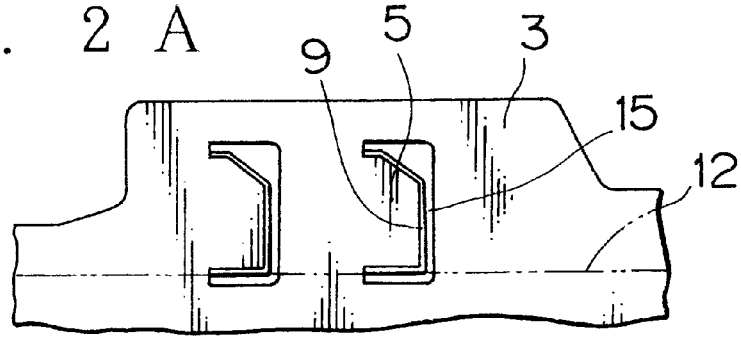
FIG. 2B
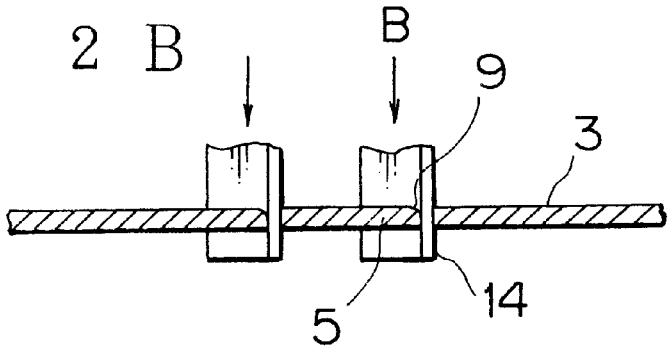

FIG. 3A
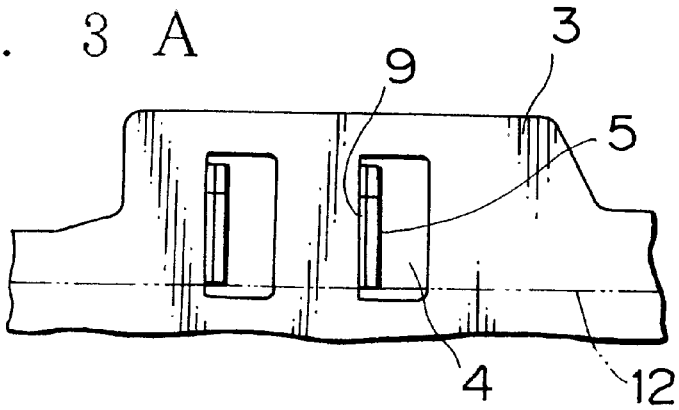
FIG. 3B
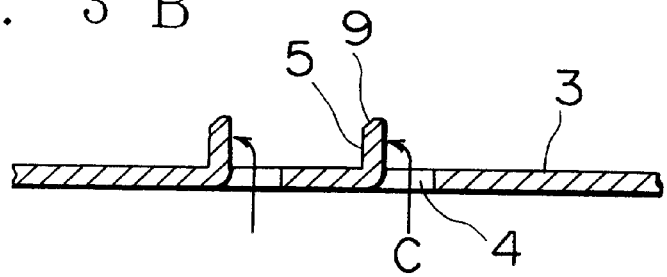
FIG. 4
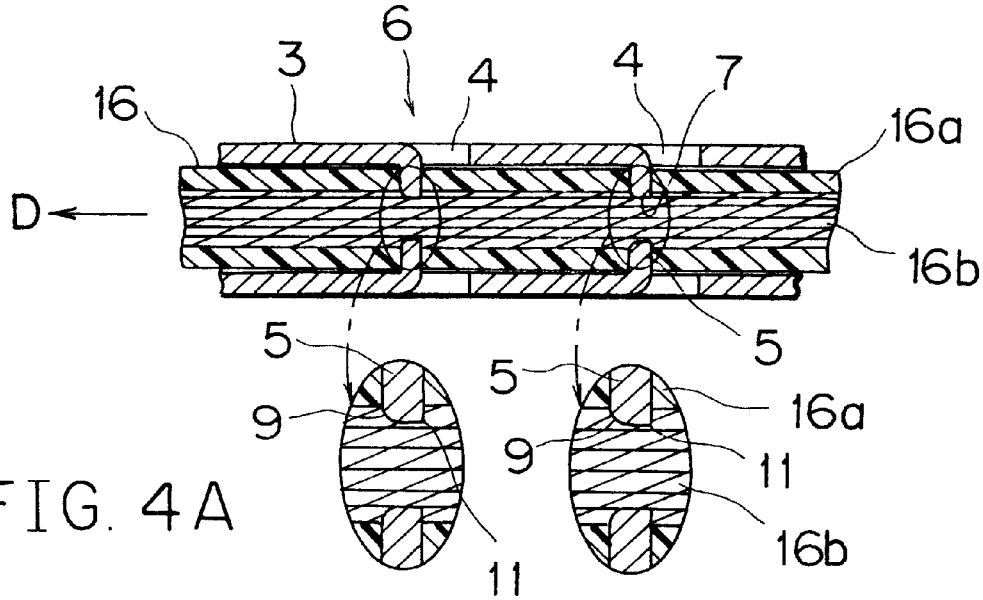
FIG. 4A
FIG. 4B

PRESSURE WELDING TERMINAL

FIELD OF THE INVENTION

The present invention relates to a pressure welding terminal where there is no anxiety that electric wire held by the pressure welding segments may slip out of the terminal due to die wears which occur on the pressure welding segments when the segments are formed by punching.

DESCRIPTION OF THE PRIOR ART

A conventional pressure welding terminal 21 is shown in FIG. 5 as an example. The pressure welding terminal 21 is formed with a terminal connecting portion 23, which is to be connected with the other terminal, at the front end portion of a base plate 22, a solderless wire connecting portion 24 at the intermediate part of the base plate 22, and a wire cover cramping portion 25 at the rear end portion of the base plate 22, respectively.

The other terminal connecting portion 23 is formed into a box shape and has a contact spring 26 interiorly. The solderless wire connecting portion 24 is constituted by front and rear pairs of pressure welding segments 27 and 27' and left and right side walls 28 each linking front and rear pressure welding segments 27 and 27'. The pressure welding segments 27 and 27' are formed by inwardly bending the front and rear ends of the side walls 28. Between a pair of opposed pressure welding segments 27, there is formed a front slot 29. Likewise, a rear slot 29 is formed between the rear pressure welding segments 27'. The aforementioned wire cover cramping portion 25 consists of a pair of left and right cramping segments.

FIGS. 6 and 7 show the state of electric wire 30 connected to the solderless wire connecting portion 24 by pressure welding. The electric wire 30 is press fitted into the front and rear slots 29 formed between the front pressure welding segments 27 and between the rear pressure welding segments 27'. The cover 30*a* of the electric wire 30 is cut or sheared by the blades 31 of the pressure welding segments 27 and 27', and the wire conductor portion 30*b* of the electric wire 30 contacts the pressure welding segments 27 and 27', thereby obtaining an electrical connection.

FIGS. 8 and 9 show a method of forming the solderless wire connecting portion 24. That is, in order to form the pressure welding segments 27 and 27' and the side walls 28 of FIG. 6, a strip of metal is set on a die 32 and is punched from the upper side by a punch 34, as shown in FIG. 9. The punched side walls 28 are bent and raised from the lower side and, at the same time, the pressure welding portions 27 and 27' are bent inwardly to complete the solderless wire connecting portion 24. In FIG. 8, reference numerals 23 and 25 correspond to the terminal connecting portion 23 for the other terminal and the wire cover cramping portion 25 of FIG. 5, respectively.

However, in the aforementioned conventional pressure welding terminal 21, when a strip of metal is punched to form the pressure welding segments 27 and 27', round shaped die wears 33 occur at the upper ends of the pressure welding segments 27 and 27', as shown in FIG. 9. As shown in FIG. 7, since the rounded die wears 33 of the inwardly bent pressure welding segments 27 and 27' come to the inner sides of the slots 29, a wire holding force is reduced at the rear pressure welding segments 27'. Therefore, when the electric wire 30 is pulled, there is the anxiety that the electric wire 30 will easily be slipped out of the pressure welding segments 27 and 27'. That is, there is the fear that the contacted portion of the electric wire 30 will slide out of the pressure welding segments 27 and 27' along the round shaped die wears 33.

Accordingly, it is an object of the present invention to provide a pressure welding terminal where, when electric wire is pulled, there is no possibility that a wire holding force will be reduced due to die wears which occur on pressure welding segments when the pressure welding segments are formed by punching.

SUMMARY OF THE INVENTION

To achieve the aforementioned object, there is provided a pressure welding terminal which comprises at least one pair of pressure welding segments formed at the side walls, whereby the pressure welding segments are formed by raising sections of the side walls. The die wears, produced when the side walls are punched, are positioned on the side of each pressure welding segment where electric wire held by the pressure welding segments is pulled. Each of the pressure welding segments is formed by forming a U-shaped cutout slit in each of the side walls with use of a punch and raising an inner portion of the cutout slit in a direction opposite to the direction where the punch is moved.

BRIEF DESCRIPTION OF THE DRAWINGS

The present invention will be described in further detail with reference to the accompanying drawings, in which:

FIG. 1 is a perspective view showing an embodiment of a pressure welding terminal according to the present invention;

FIG. 2A is a plan view showing how the pressure welding segments of FIG. 1 are formed by punching;

FIG. 2B is a cross sectional view showing how the pressure welding segments are formed by punching;

FIG. 3A is a plan view showing how the pressure welding segments are raised;

FIG. 3B is a cross sectional view showing how the pressure welding segments are raised;

FIG. 4 is a cross sectional view showing the state of electric wire contacted with pressure by the pressure welding segments;

DETAILED DESCRIPTION OF THE PREFERRED EMBODIMENT

Figure 5:
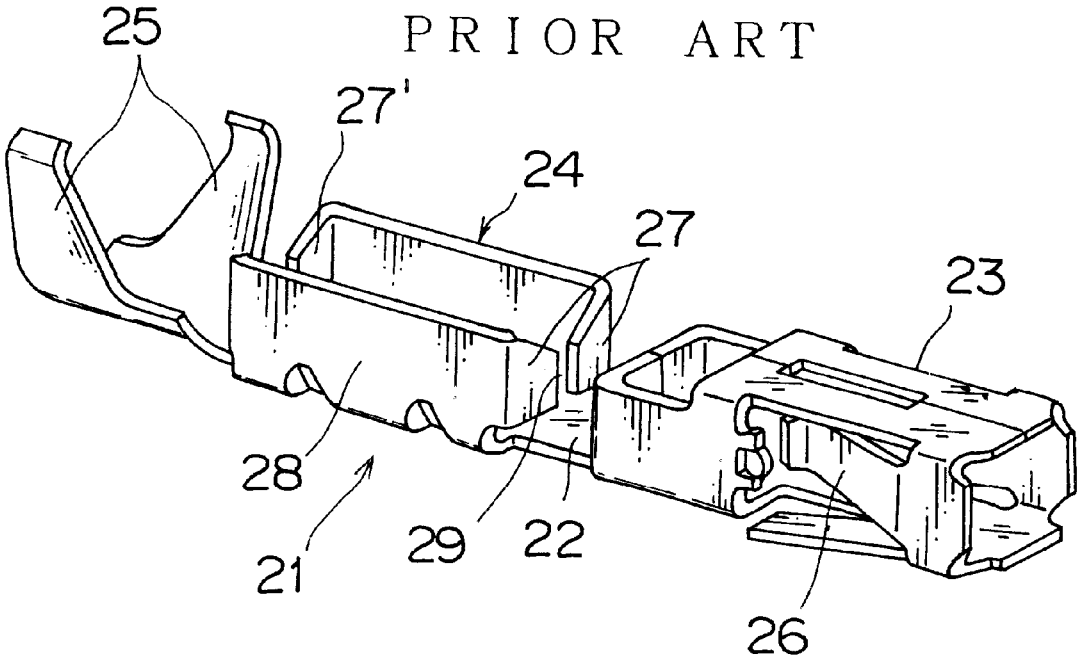
FIG. 5 PRIOR ART
FIG. 5 is a perspective view showing a conventional pressure welding terminal.
Figure 6:
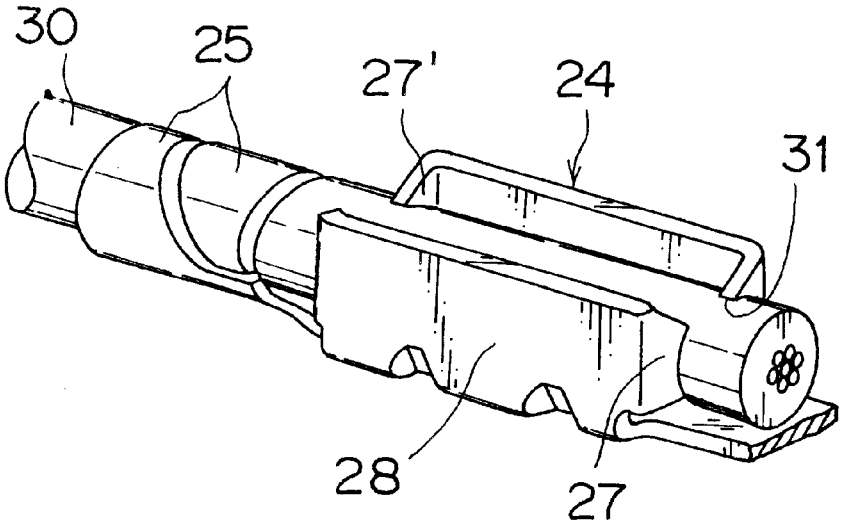
FIG. 6 PRIOR ART
FIG. 6 is a perspective view showing the state of electric wire contacted with pressure by the pressure welding portion of the terminal shown in FIG. 5.
Figure 7:
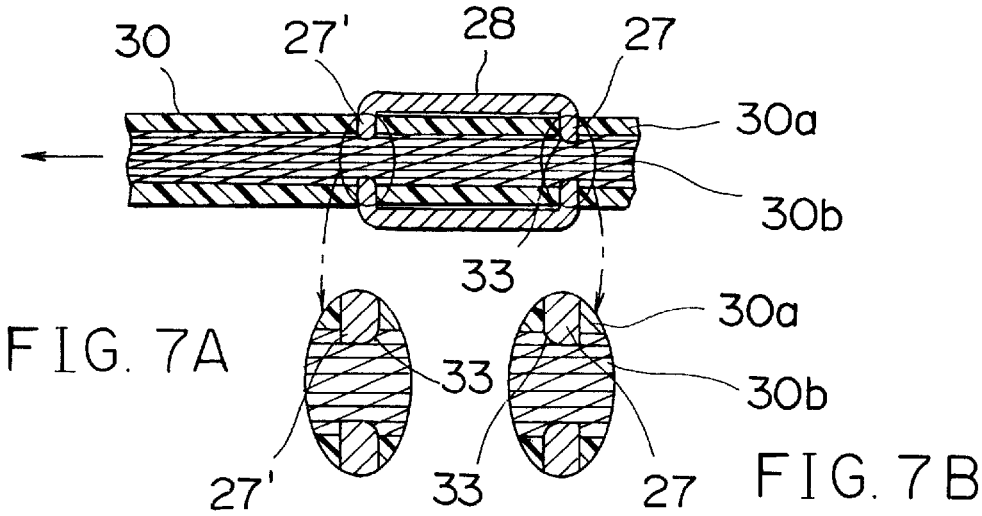
FIG. 7 PRIOR ART
FIG. 7 is a cross sectional view showing the state of electric wire contacted with pressure to the pressure welding portion.
Figure 8:
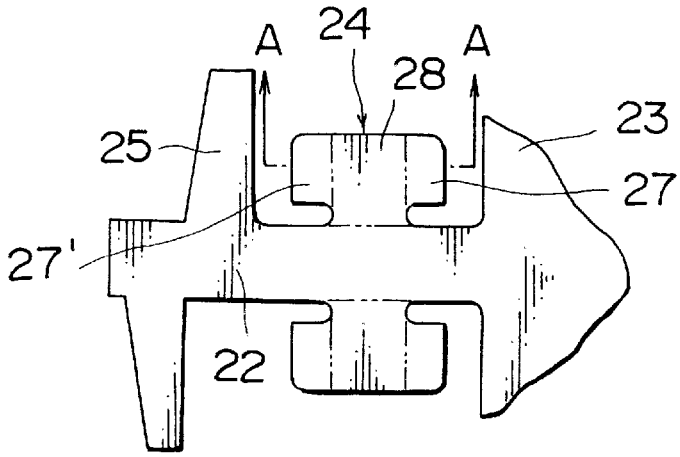
FIG. 8 PRIOR ART
FIG. 8 is a partial plan view showing the state of the developed terminal.
Figure 9:
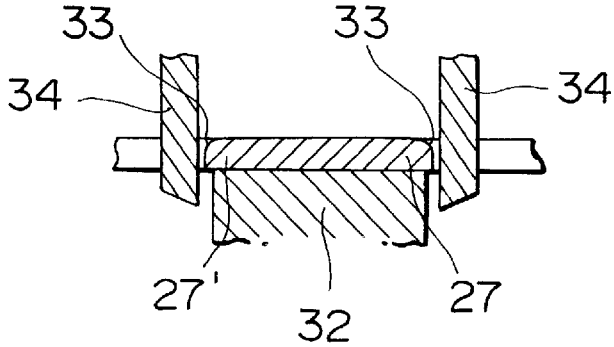
FIG. 9 PRIOR ART
FIG. 9 is a sectional view, taken along a line A—A of FIG. 8, showing how the pressure welding segments of FIG. 5 are formed by punching.

Referring to FIG. 1, there is shown a preferred embodiment of a pressure welding terminal in accordance with the present invention. At the near center of the base plate 2 of the pressure welding terminal 1, side walls 3 are raised on both sides, front and rear pairs of cutout holes 4 are formed in the side walls 3, and a pressure welding segment 5 is raised from a section of the side wall 3 near the cutout hole 4. The number of pressure welding segments 5 totals four.

The side walls 3 and the two pairs of pressure welding segments 5 as a whole constitute a wire pressure welding section 6.

Each of round shaped die wears 9 has occurred on an end of each pressure welding segment 5 on the rear side of a slot 7, that is, an end of the pressure welding segment 5 on the side of a wire cover cramping portion 8. The front ends of all pressure welding segments 5, that is, the front ends on the side of the other terminal connecting portion 10 have a right-angled sharp edge 11.

The aforementioned cutout hole 4 is produced because the pressure welding segment 5 is formed by cutting and raising a part of the side wall 3, and the cutout hole 4 extends from a bent portion 12 on the lower side of the side wall 3, exactly speaking, from the base plate 2 up to the vicinity of the upper end of the side wall 3. Between the upper end of the cutout hole 4 and the upper end of the side wall 3, a coupling portion 13 is formed to ensure the strength of the side wall 3. The left and right pressure welding segments 5 and 5 are arranged to face with each other so that the aforementioned slot 7 is formed between the pressure welding segments 5 and 5.

The rear end of the side wall 3 is continuous to the wire cover cramping portion 8 and the front end of the side wall 3 is continuous to the other terminal connecting portion 10. The interior of the other terminal connecting portion 10 is provided with a contact spring (not shown).

FIGS. 2 and 3 show a method of forming the pressure welding segment 5 by punching. The side wall 3 shown in FIGS. 2 and 3 corresponds to the left side wall 3 of FIG. 1.

First, with the terminal 1 developed as shown in FIGS. 2A and 2B, U-shaped cutout slits 15 are punched out by moving a punch 14 from the upper side of the side wall 3 in the direction indicated by an arrow B, and a total of 4 slits are formed in both side walls 3. At this time, the pressure welding segment 5 is formed inside of each U-shaped cutout slit 15. At the same time, die wear 9 is caused to occur on the edge of each pressure welding segment 5 on the upper surface side by the punch 14.

Next, as shown in FIGS. 3A and 3B, each pressure welding segment 5 is raised from the lower side of the side wall 3 in the direction indicated by an arrow C and is bent at right angles. After the bending of the pressure welding segment 5, the cutout hole 4 is produced. The rounded die wear 9 is positioned at the outer end in the bending direction of each pressure welding segment 5, that is, the end on the side of the wire cover cramping portion 8 of FIG. 1.

FIG. 4 shows the state of electric wire contacted with pressure by the wire pressure welding portion 6. The electric wire 16 is press fitted into the slot 7 between each pair of pressure welding segments 5. The cover 16*a* of the electric wire 16 is cut by the right-angled sharp edges of the pressure welding segments 5, and the sharp edges bite into the wire conductor portion 16*b* and contact the wire conductor portion 16*b*. At this time, at the slots 7 of all pressure welding segments 5, the die wears 9 are positioned in the direction (indicated by an arrow D) where the electric wire is pulled, and the right-angled sharp edges of the pressure welding segments 5 are positioned in the opposite direction.

With this arrangement, when a tensile force is exerted on the wire 16 held by the pressure welding segments 5, the edges 11 of all pressure welding segments 5 bite into the cover portion 16*a* and the conductor portion 16*b* of the electric wire 16 so that the wire 16 is caught by the edges 11. Therefore, slip-out of the electric wire 16 is prevented. In addition, since the sheared area of the wire conductor portion 16*a* is increased by the edges 11, the electrical contact between the edges 11 and the wire conductor portion 16*b* is performed reliably. This electrical contact is not influenced by the pulling of the electric wire 16 but rather enhanced.

According to the present invention, as previously described, the die wear on the pressure welding segment is positioned at a tension side thereof where applied is a tension of a connected electric wire being pulled. Therefore, when electric wire is pulled, the wire is caught by the sharp edge on the opposite side of the die wear and therefore slip-out of the electric wire is prevented. At the same time, reliable electrical contact is maintained as being held by the edge.

While the present invention has been described with reference to a preferred embodiment thereof, the invention is not to be limited to the details given herein, but may be modified within the scope of the appended claims.

What is claimed is:

1. A pressure welding terminal comprising:

at least one pair of pressure welding segments formed at side walls of a terminal, wherein each of said pressure welding segments includes a raised part of said side walls and a die wear caused at the edge portion of said pressure welding segments by punching, wherein said die wear of each of said pressure welding segments is positioned in a direction where a connected electric wire is pulled.

2. The pressure welding terminal as set forth in claim 1, wherein each of said pressure welding segments is formed by raising an inner portion of a U-shaped cutout slit, punched at each of said side walls, in a direction opposite to a direction of punching.

3. The pressure welding terminal as set forth in claim 1 or 2, wherein said pressure welding segments consist of front one pair and rear one pair of pressure welding segments.

4. The pressure welding terminal as set forth in claim 3, wherein said pressure welding segments are arranged to face with each other to form a slot therebetween into which an electric wire is press fitted.

5. The pressure welding terminal as set forth in claim 3, further comprising a right-angled sharp edge opposite said die wear of each of said pressure welding segments, wherein said right-angled sharp edge is positioned opposite said direction where said connected electric wire is pulled.

* * * * *